US005961166A

United States Patent [19]

Edwards

[11] Patent Number: 5,961,166

[45] Date of Patent: Oct. 5, 1999

[54] AUTOMOTIVE VEHICLE DOOR HANDLE ASSEMBLY

[75] Inventor: Sean Edwards, Coventry, United Kingdom

[73] Assignee: Jaguar Cars, Limited, Whitley Coventry, United Kingdom

[21] Appl. No.: 09/143,209

[22] Filed: Aug. 28, 1998

[30] Foreign Application Priority Data

Aug. 28, 1997 [GB] United Kingdom ..... 9718064

[51] Int. Cl.[6] ..... E05B 3/00

[52] U.S. Cl. ..... 292/336.3; 292/DIG. 31; 292/347

[58] Field of Search ..... 292/336.3, 347, 292/DIG. 31, DIG. 62, DIG. 24; 70/202, 204

[56] References Cited

U.S. PATENT DOCUMENTS

| | | | |
|---|---|---|---|
| 3,606,428 | 9/1971 | Erck et al. . | |
| 4,838,590 | 6/1989 | Isomura | 292/336.3 |
| 5,011,202 | 4/1991 | Kato et al. | 292/336.3 |
| 5,794,994 | 8/1998 | Miyagawa et al. | 292/336.3 |

FOREIGN PATENT DOCUMENTS

| | | |
|---|---|---|
| 0-169-644-A2 | 6/1985 | European Pat. Off. . |
| 2199363 | 7/1988 | United Kingdom . |
| 2-267-116 | 11/1993 | United Kingdom . |

*Primary Examiner*—Steven Meyers
*Assistant Examiner*—Teri Pham
*Attorney, Agent, or Firm*—Steven A. Maynard

[57] ABSTRACT

An interior door handle assembly for locking and releasing a door latch mechanism is connected to the door latch mechanism by a single push/pull operating cable. The latch mechanism has a release lever and a locking lever, the release lever and locking lever being pivotally mounted about axes which are parallel but spaced from one another. The push/pull cable is connected to the locking lever and the locking lever has a formation which, when the latching mechanism is in a latched but unlocked condition will extend into the path of the release lever so that upon movement of the release lever to release the latch mechanism, the formation will be engaged by the release lever to pull the cable. The formation is moved out of the path of the release lever when the locking lever is moved to lock the latch mechanism.

6 Claims, 3 Drawing Sheets

AUTOMOTIVE VEHICLE DOOR HANDLE ASSEMBLY

FIELD OF THE INVENTION

The present invention relates to interior door handle assemblies for motor vehicles, and more specifically, to an electrical continuity interlock for such systems.

BACKGROUND OF THE INVENTION

Conventional interior door handle assemblies for motor vehicles include a release lever by which the door latch mechanism may be released to permit the door to be opened and a locking lever by which the door latch mechanism may be locked from inside the vehicle. Typically, the release lever and locking lever are connected independently to the door latch mechanism.

In accordance with EP 0169644, it has been proposed to connect both the release lever and the locking lever to the door latch mechanism by a single push/pull cable. This is achieved by moving the cable in one direction from a normally latched position, to lock the latch mechanism and moving the cable in the opposite direction to release the latch mechanism. With the mechanism disclosed in this specification, actuation of the release lever when the latch mechanism is locked, will unlock and release the latch mechanism in one operation.

While this form of operation is may be desirable in certain circumstances, for the rear interior door handles particularly, two separate operations are preferred to unlock and then release the latch mechanism.

In accordance with GB 2,199,363 and GB 2,267,116, the latch mechanism is locked by movement of the release lever from the normal latched position in the direction opposite to the direction of movement to release the latch mechanism. The release lever is held in the locked position by detent means and must be released by actuation of a button, which will unlock the latch mechanism before the release lever can be actuated to release the latch mechanism so that the door may be opened. While these mechanisms are plausible for rear interior door handles, they are not easily adapted to provide unlocking and release of the latch mechanism in a single operation, which may be used for front interior door handles and rear interior door handles where desired.

SUMMARY OF THE INVENTION

Responsive to the deficiencies in the prior art, the present invention provides an interior door handle assembly for locking and releasing a door latch mechanism using a single push-pull operating linkage between the door handle assembly and the latch mechanism including; a release lever pivotally mounted about a first axis and a locking lever pivotally mounted about a second axis, the first and second axes being parallel but spaced from one another, the release lever being rotatable in one direction from a first position in which the latch mechanism is in a latched condition to a second position in which the latch mechanism is in a released condition, the locking lever being rotatable in an opposite direction between a first position in which the latch mechanism is in a latched but unlocked condition to a second position in which the latch mechanism is in a locked condition, a push/pull operating linkage being connected at one end to the locking lever and at the other end to the latch mechanism, a formation being provided on the locking lever which, when the locking lever is in its first position lies in the path of the release lever as the release lever moves from its first position to its second position; the formation being outside the path of the release lever as the release lever moves from its first position to its second position, when the locking lever is in its second position.

In accordance with the present invention, the latch mechanism may be locked by movement of the locking lever from its first position to its second position. In this position, the formation on the locking lever is outside the path of the release lever and consequently movement of the release lever from its first to its second position will have no effect. When however the locking lever is returned to its first position to unlock the latch mechanism, upon movement of the release lever from its first position to its second position, engagement of the formation on the locking lever by the release lever will cause the locking lever to rotate with the release lever to release the latch mechanism.

The interior door handle assembly described herein may simply be adapted, so that the formation on the locking lever remains in the path of the release lever from its first to its second position, when the locking lever is in either its first or second position, so that unlocking and release of the latch mechanism may be achieved in a single operation by movement of the release lever from its first to its second position.

BRIEF DESCRIPTION OF THE DRAWINGS

Other features and advantages of the present invention will become apparent to those skilled in the automotive vehicle latch assembly arts upon reading the following description with reference to the accompanying drawings, in which.

DETAILED DESCRIPTION OF THE PREFERRED EMBODIMENT

Figure 1:
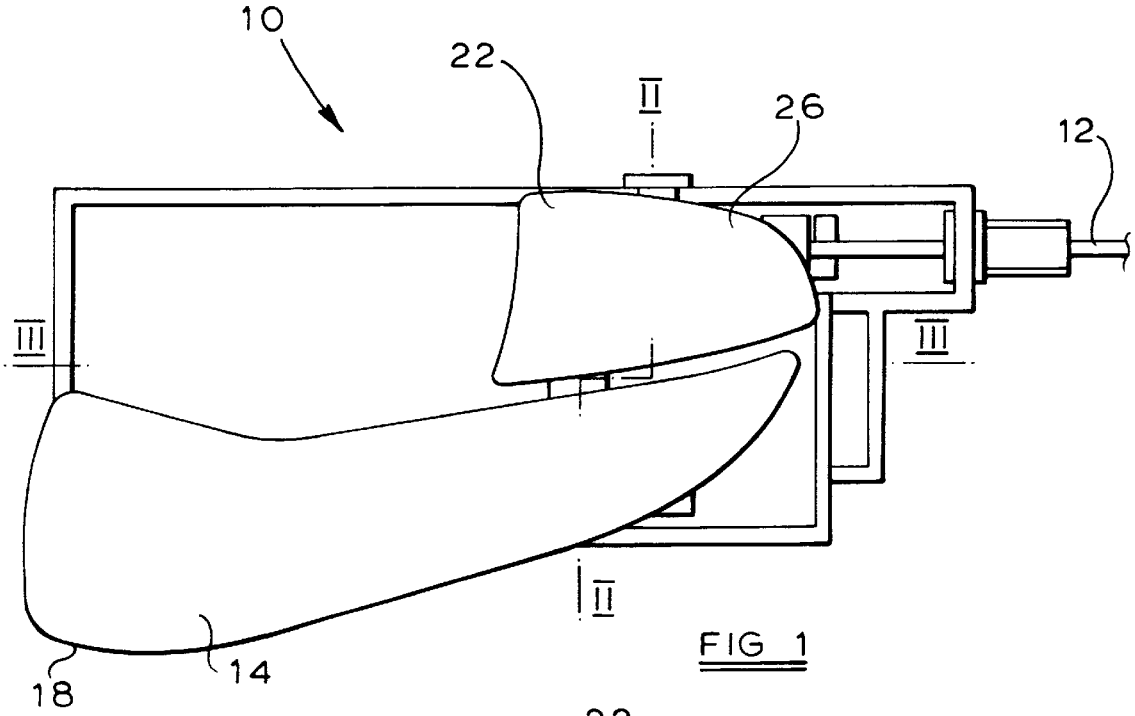
FIG. 1 is a side elevation of an interior door handle in accordance with the present invention.

Turning now to the drawings, and in particular to FIG. 1 thereof, an interior door handle 10 is shown for operating a door latch mechanism (not shown) by means of a single push/pull cable 12.

The door latch mechanism may be as described in European Patent Specification EP 0169644, incorporated herein by reference, in which the push/pull cable 12 acts on release and locking levers in the latch mechanism, the cable controlling the release and locking levers so that from a position in which the latch mechanism is latched but unlocked, pushing the cable 12 will lock the latch mechanism and pulling the cable 12 will release the latch mechanism.

Figure 2:
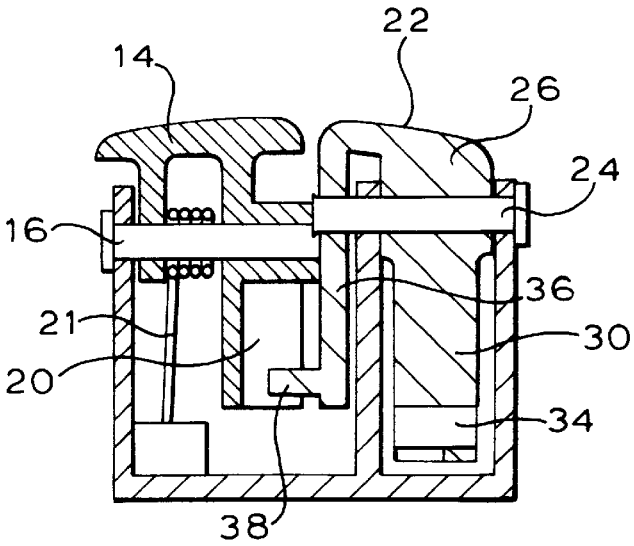
FIG. 2 is a sectional view along the line II—II of FIG. 1.
Figure 3:
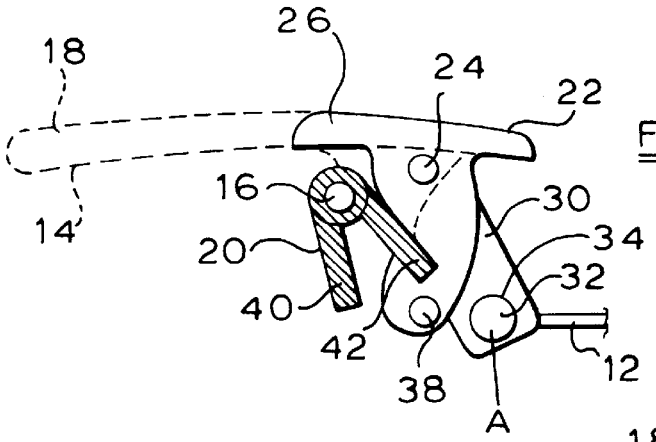
FIG. 3 is a partial sectional view along the line III—III of FIG. 1, showing the interior door handle in a locked position.

The interior door handle 10 has a release lever 14, which is pivoted about pivot 16 as shown in FIG. 2. The release lever 14 has a handle portion 18. When the interior door handle 10 is fitted, the handle portion 18 release lever 14 is in its normal rest, or latched position, as illustrated in FIG. 3, and extends substantially in the plane of the door panel. The handle portion 18 may be rotated in a clockwise direction from its normal rest position, to a released position to release the latch mechanism. The handle portion 18 extends to one side of the pivot 16, which is located below the plane of the handle portion 18. The release lever 14 also has a bifurcated portion 20, which extends opposite the handle portion 18, relative to the pivot 16. A torsion spring 21, shown in FIG. 2, is provided to bias the release lever 14 to its normal rest position.

A locking lever 22, as further shown in FIG. 2, is pivoted in juxtaposed relationship to the release lever 14, about pivot 24. Pivot 24 is located above and to said other side of pivot 16. The locking lever 22 has a handle portion 26, which extends from the pivot 24 in the same direction as the handle portion 18 of release lever 14. In a locked position, the handle portion 26 of the locking lever 22 is substantially co-planar with the handle portion 18 of the release lever 14. The handle portion 26 of locking lever 22 may be rotated clockwise to an unlocked position and then to a released position. The locking lever 22 has a first arm 30 extending to the opposite side of pivot 24 as the handle portion 26. The push/pull cable 12 is connected to the first arm termination 32 on the end of cable 12 engaging a retaining formation 34 on the arm 30, in conventional manner.

A second arm 36, as still further shown in FIG. 2, extends to the opposite side of pivot 24, a pin 38 being provided on the second arm 36, the pin 38 extending parallel to the pivot 24, the pin 38 extending through the plane of movement of the bifurcated portion 20 of release lever 14.

Figure 4:
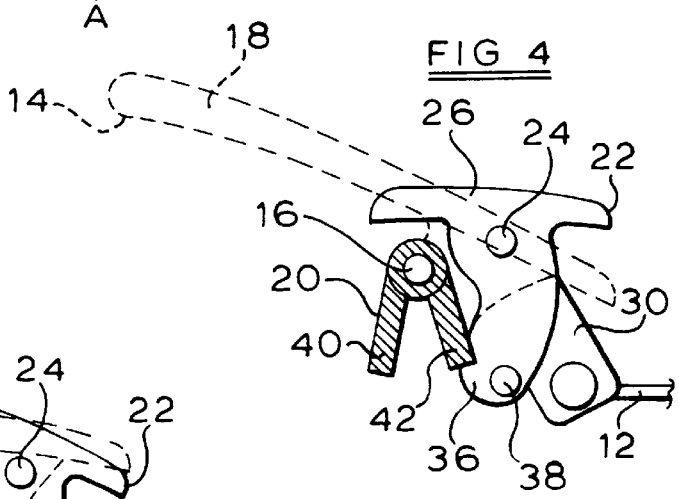
FIG. 4 is a view similar to FIG. 3 illustrating operation of the release lever when the interior door handle is in a locked position.

As illustrated in FIG. 3, when the locking lever 22 is in the locked position, the cable 12 is pushed to position A and the locking lever of the latch mechanism locks the latch mechanism. In this position, the pin 38 is located outside the path of the arms 40, 42 of the bifurcated portion 20 of release lever 14, as the release lever 14 is rotated about pivot 16. Consequently, actuation of the release lever 14 when the locking lever 22 is in the locked position, will have no effect as illustrated in FIG. 4.

Figure 5:
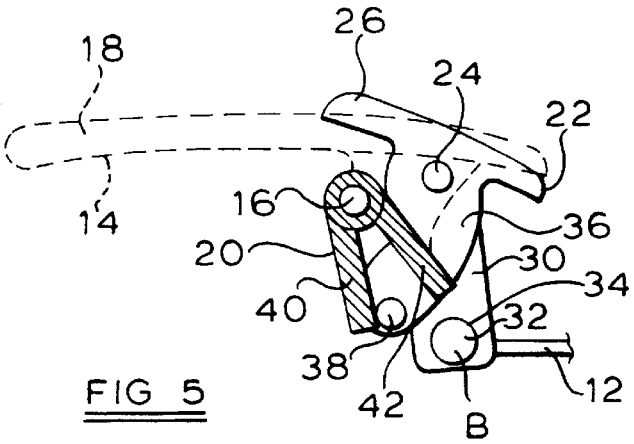
FIG. 5 is a view similar to FIG. 3 illustrating the interior door handle in an unlocked position.
Figure 6:
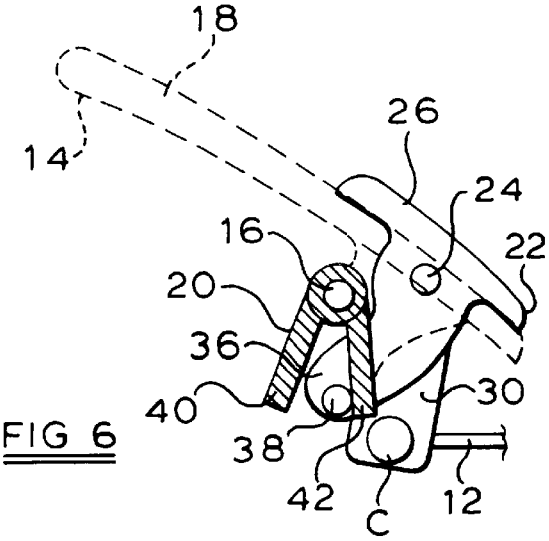
FIG. 6 is a view similar to FIG. 4 illustrating the operation of Se release lever when the interior door handle is in an unlocked position.

When the locking lever 22 is rotated clockwise to the unlocked position, illustrated in FIG. 5, the cable 12 is pulled to the position B and the locking lever of the latch mechanism will be moved to an unlocked position. Movement of the locking lever 22 to this position will move pin 38 into engagement with the lower arm 40 of the bifurcated portion 20 of release lever 14, and into the path of movement of the upper arm 42, as the release lever 14 is rotated clockwise about pivot 16. Rotation of the release lever 14 from its normal rest position as illustrated in FIG. 5, to the position illustrated in FIG. 6, will first bring arm 42 of the bifurcated portion 20 into engagement with pin 38 and will then cause the locking lever 22 to rotate clockwise, moving cable 12 to position C and causing the release lever of the latch mechanism to release the latch mechanism.

Upon release of the release lever 14, the spring 21 will bring the lever 14 back to its normal rest position, as illustrated in FIG. 5, abutment of the pin 38 by arm 40 bringing the locking lever 22 back to its unlocked position.

The interior door handle described above will consequently require separate operations to unlock and release the latch mechanism, as required by U.S. federal legislation, for rear interior door handles.

Figure 7:
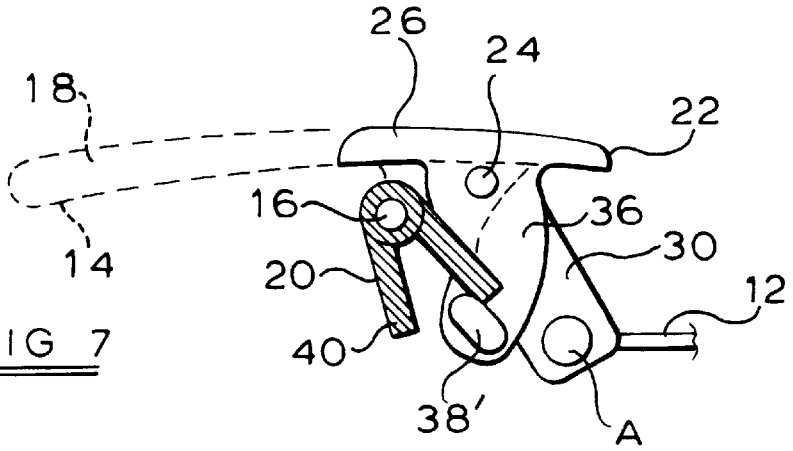
FIGS. 7 to 9 show views similar to FIGS. 3, 5 and 6 respectively of a modified embodiment of the interior door handle illustrated in FIGS. 1 and 2.
Figure 8:
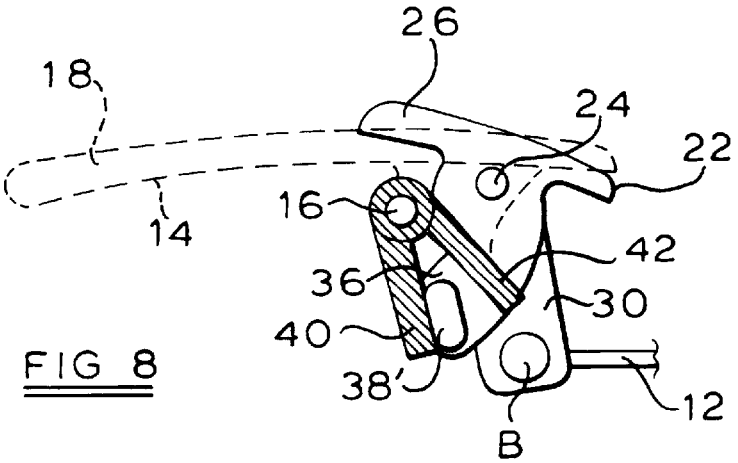
Figure 9:
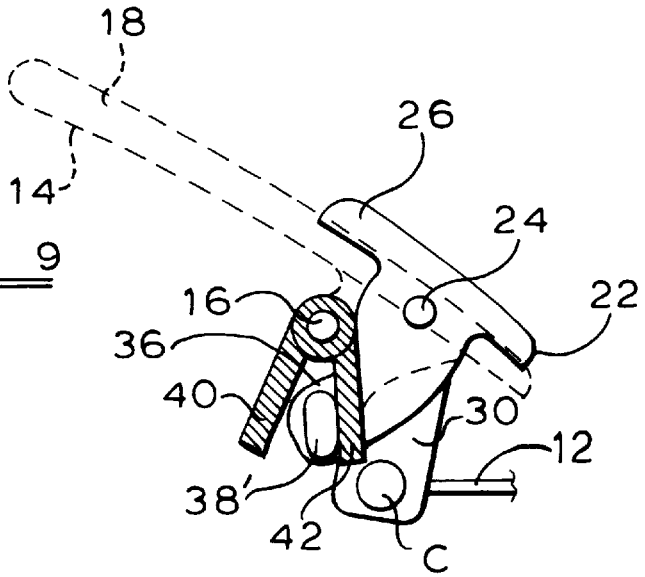

In the alternate embodiment illustrated in FIGS. 7 to 9, the pin 38 of the locking lever 22 is replaced by an elongate projection 38', which will remain in the path of the arms 40, 42 of the bifurcated part 20 of release lever 14, when the locking lever is in the locked position, as illustrated in FIG. 7. As illustrated in FIG. 7, with this embodiment, when the locking lever 22 is in the locked position, the projection 38' will engage the upper arm 42 of the bifurcated portion 20 when the release lever 14 is in its normal rest position. Movement of the locking lever 22 to unlock the latch mechanism moves the projection 38' down into engagement with the lower arm 40 of bifurcated portion 20, as illustrated in FIG. 8. The locking lever 22 may therefore be used independently to lock or unlock the latch mechanism. However, even when the locking lever 22 is in the locked position, actuation of the release lever 14 by rotation in a clockwise direction, will cause the locking lever 22 to rotate, first unlocking the latch mechanism and then releasing the latch mechanism, in a single operation as illustrated in FIG. 9.

The interior door handle assembly according to the present invention may consequently be easily adapted for single or two-stage operation, as required by local legislation. While in the above embodiments, the different form of the pin 38 and projection 38', will require different parts to be used, in an alternative embodiment, a single part may be provided with alternative positions for location of the pin 38.

We claim:

1. An interior door handle assembly for locking and releasing a door latch mechanism using a single push/pull operating linkage between the door handle assembly and the latch mechanism, comprising:

a release lever pivotally mounted about a first axis;

a locking lever pivotally mounted about a second axis, the first and second axes being parallel but spaced from one another;

the release lever being rotatable between a first position in which the latch mechanism is in a latched condition to a second position in which the latch mechanism is in a released condition;

the locking lever being rotatable between a first position in which the latch mechanism is in a latched but unlocked condition to a second position in which the latch mechanism is in a locked condition;

a push/pull operating linkage being connected at one end to the locking lever and at the other end to the latch mechanism; and a pin disposed on the locking lever and a means disposed on the release lever for engaging the pin wherein the pin engages the release lever only when the locking lever is in the first position.

2. An interior door handle assembly according to claim 1 wherein said means on the release lever has a bifurcated portion defining a pair of arms, the sin on the locking lever being located between said arms, when the locking lever is in its first position, one arm of the bifurcated portion of the release lever engaging the pin on the locking lever as the release lever is rotated from its first to its second position, thereby causing the locking lever to rotate from its first position in the opposite direction to its second position, to release the latch mechanism, the locking lever being returned to its first position by abutment of the pin by the other arm of the bifurcated portion, as the release lever moves back to its first position.

3. An interior door handle assembly according to claim 1 wherein the locking lever has a first arm connected to one end of the push/pull linkage, and a second arm with the pin provided thereon.

4. An interior door handle assembly according to claim 1 wherein the release lever is resiliently biased to the first position.

5. An interior door handle assembly according to claim 1 wherein the push/pull linkage is a push/pull cable.

6. An interior door handle assembly according to claim 1 wherein the release lever and locking lever each have a handle portion that are substantially co-planar when the release lever is in its first position and the locking lever is in its second position.

* * * * *